United States Patent [19]

Cornwell, Jr. et al.

[11] 4,190,192

[45] Feb. 26, 1980

[54] THEFT PREVENTING OUTDOOR MAILBOX

[75] Inventors: Alexander M. Cornwell, Jr., St. Louis; Joseph N. Miller, Overland, both of Mo.

[73] Assignee: Jackes-Evans Manufacturing Company, St. Louis, Mo.

[21] Appl. No.: 851,138

[22] Filed: Nov. 14, 1977

[51] Int. Cl.[2] ..... B65D 91/00

[52] U.S. Cl. ..... 232/17; 232/34; 232/45

[58] Field of Search ..... 232/20–24, 232/17, 33, 34, 35, 36, 37, 38, 39, 45

[56] References Cited

U.S. PATENT DOCUMENTS

| | | | |
|---|---|---|---|
| 462,224 | 10/1891 | Strong | 232/17 |
| 869,844 | 10/1907 | Hushour | 232/35 |
| 1,164,935 | 12/1915 | Fisher | 232/35 |
| 1,209,550 | 12/1916 | Buckwalter | 232/17 |
| 2,498,260 | 2/1950 | Fabis | 232/34 |
| 3,758,027 | 9/1973 | Morgan | 232/17 |
| 3,802,619 | 4/1974 | Vanderveer | 232/35 X |

*Primary Examiner*—Roy D. Frazier
*Assistant Examiner*—Peter A. Aschenbrenner
*Attorney, Agent, or Firm*—Kirkland & Ellis

[57] ABSTRACT

A mailbox of the type that is located outdoors and is exposed to all weather conditions has an access aperture with a door adapted to selectively open the aperture for removal of mail in the mailbox. A lock mounting arrangement is provided to permit the mailbox to be locked to prevent unauthorized removal of the mail. In addition, a mail slot sufficiently large to permit the insertion of mail but small enough to prevent access for removal of the mail is provided. A pivoted flap covers the mail slot. Appropriate shielding means, such as the top and sides of a specially shaped mailbox, protect the door, the mail slot and the lock mounting from inclement weather conditions.

5 Claims, 11 Drawing Figures

THEFT PREVENTING OUTDOOR MAILBOX

BACKGROUND OF THE INVENTION

1. Field of the Invention

This invention relates generally to outdoor mailboxes, and more specifically, this invention relates to outdoor mailboxes having a provision for preventing theft or other unauthorized removal of mail from the mailboxes.

2. Description of the Prior Art

Outdoor mailboxes utilized in the past have generally been the so-called "rural" mailboxes found along any country road. These rural mailboxes have a generally domed shape with a front opening door pivoted at the bottom. The pivoted door fits over the portion of the mailbox body forming the frontal access opening, in order to prevent the elements from reaching the interior of the mailbox body. A flexible latching arrangement is provided at the top of the door in order to latch the door in the closed position.

These rural mailboxes are generally mounted on a pole or other supporting member at a height such that a mailman sitting in an automobile can open the door and insert mail into the body of the mailbox. A pivoted flag is located on the side of the box, so that the mailbox owner may indicate when there is mail to be picked up by the mailman. These rural mailboxes are generally mounted in a free standing fashion on individual mounting poles or supports.

One of the problems that has increased considerably in recent times is the theft of mail from private outdoor mailboxes. There are a number of factors that contribute to this problem, such as the growth in population, the greater mobility of young people as well as more serious thieves, and the lack of personal acquaintanceship. Another aspect of the problem of theft is that many new suburban housing developments are not providing for delivery of mail to the door of each house, but instead are utilizing outdoor mailboxes that are more easily accessible to the mailmen. These steps are strongly being urged by the United States Post Office Department, in an attempt to reduce the cost of mail delivery. Also, the "ganging" or assembly of a large number of outdoor mailboxes at a central location is being strongly urged upon suburban housing developers, as explained more fully in the co-pending patent application of Alexander M. Cornwell, Jr. entitled "Ganged Mail Box Apparatus", Ser. No. 812,373, filed on July 1, 1977.

From the standpoint of the Post Office Department, many of the theft problems have been alleviated for the pickup of mail by the use of the large domed collection boxes, as well as the smaller, usually pole mounted, type of collection box. Both of these types of collection boxes utilize a pivoted cover for a mail inserting slot, the slot being too small to prevent access for removal of mail in the boxes. The Post Office employees then come at designated collection times to remove the mail in the boxes for posting by opening an access door for which they have a key. While these collection boxes are quite useful, especially in the metropolitan and suburban areas for which they are intended, they are not completely satisfactory. Further, these collections boxes do not solve the problem of theft of delivered mail from the individually owned mailboxes. Therefore, it would be desirable to be able to give each individual mailbox owner protection of the mail delivered to him by the Post Office Department.

Mail slots formed in the doors of buildings, or a plurality of combined individual boxes in a common entry way, are sometimes useful, but they do not solve the problem of outdoor mailboxes, either individually mounted or ganged with a plurality of others. Therefore, there is a need for an outdoor mailbox that can provide protection of delivered mail and is suitable for use in both rural and suburban areas.

SUMMARY OF THE INVENTION

With the present invention, there is provided an outdoor mailbox into which a mailman may easily insert mail, so that unauthorized removal of the mail in the mailbox is precluded. These features are combined with a new ornamental design, as claimed in the co-pending design patent application of Alexander M. Cornwell, Jr. and Joseph N. Miller for a "Mailbox" ornamental design, assigned to the same assignee as the present application.

The mailbox of the present invention includes a body portion for holding and protecting mail. This body portion is elongated and has a generally trapezoidal cross section along the longitudinal axis. This trapezoidal cross section extends from the lower back corner to the upper front corner, the access opening being located in the front of the body portion of the mailbox. A flag is mounted on the side of the body portion of the mailbox with a two-position arrangement for supporting the flag in the retracted position when there is no mail to be picked up, and in the extended position when there is mail to be picked up. At the front of the body portion there is located a pivotably mounted door to selectively open and close the access opening. This door is pivoted along its bottom edge in the lower front corner of the body portion. In the closed position, this door contacts an appropriate locking bar extending across the mailbox. Dimples formed in the sides of the mailbox body abut an appropriate tab formed on the door to latch the door in a closed position by means of an interference fit between the dimples and tabs.

A locking bight is provided on the locking bar for the attachment of an appropriate lock, such as a padlock. This bight extends through an appropriate slit formed in the door, when the door is abutting the locking bar, so that a lock may be attached to maintain the door in a closed position and prevent unauthorized opening of the door.

Above the locking bar, there is provided a mail slot by means of which mail may be inserted into the body of the mailbox, but which is not sufficiently large to permit extraction of mail already in the box. An appropriate flap is pivotably mounted on the top of the mailbox, so that it normally rests against the locking bar. When mail is being inserted, the flap is pivoted upwardly and inwardly to permit insertion of the mail.

As a result of the trapezoidal cross section of the mailbox along its longitudinal axis, the top and sides of the body portion, at the front end of the mailbox, provide protection for the mail slot, as well as the locking bight and the door itself. Since the door fits inside the body portion of the mailbox, the protection of this door prevents the intrusion of moisture from inclement weather conditions.

Along the top of the door, there is mounted a member having a generally L-shaped cross section to provide a handle.

In this fashion, a mailbox is provided in which a mailman may insert mail through a slot too small to prevent removal of the mail therethrough. By means of an appropriate locking arrangement, only authorized personnel may remove the mail. By means of the trapezoidal cross section of the mailbox along its longitudinal axis, a natural shield for the mail slot, the door and the locking bight are provided. Thus, a theft preventing arrangement, including provisions for protecting the interior of the mailbox body from adverse weather conditions, is provided.

These and other objects, advantages and features of this invention will hereinafter appear, and for purposes of illustration, but not to limitation, an exemplary embodiment of the subject invention is shown in the appended drawing.

DETAILED DESCRIPTION OF THE PREFERRED EMBODIMENT

Figure 1:
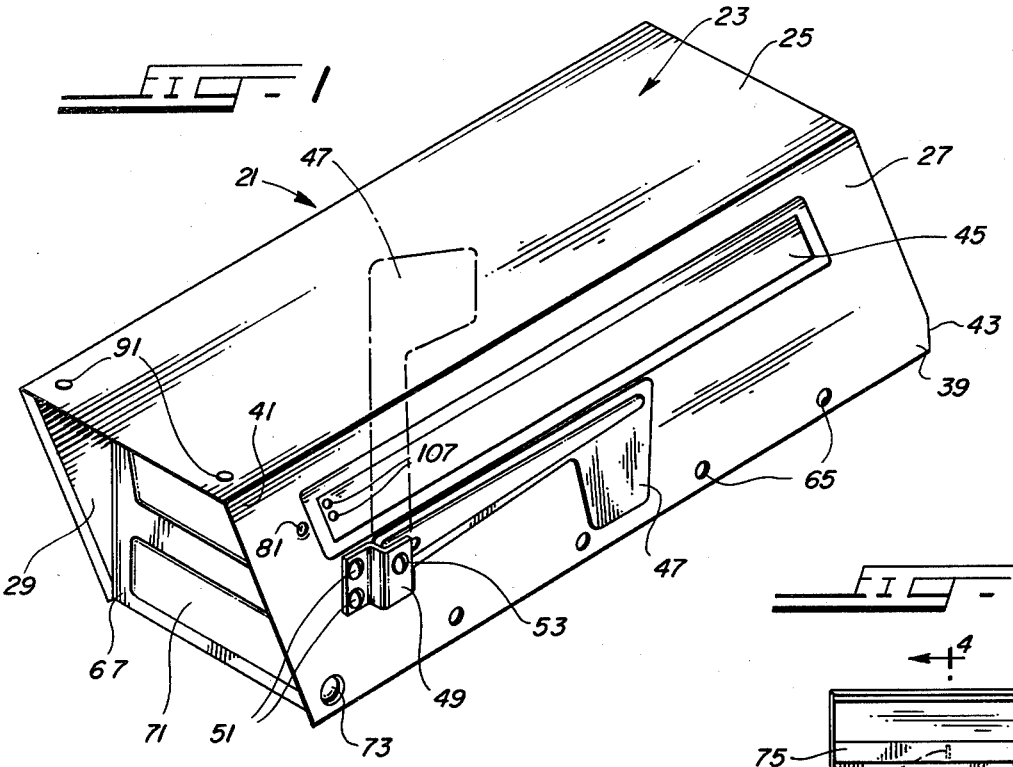
FIG. 1 is a perspective view of a mailbox constructed in accordance with the present invention.
Figure 2:
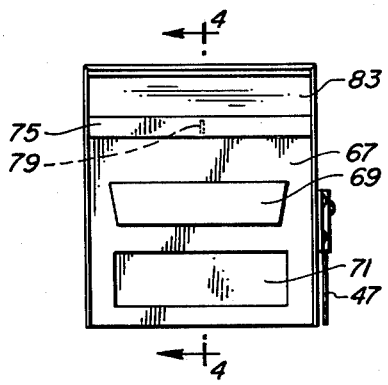
FIG. 2 is a front elevational view of the mailbox of FIG. 1.

An outdoor mailbox 21 is constructed in accordance with the present invention. Mailbox 21 has a body portion 23, which includes a top 25, sides 27 and 29, a bottom 31 (see FIG. 4), and a back 33 (see FIG. 4). The front of mailbox 21 is generally open to provide a mail slot 35 and an access opening 37 (see FIG. 6).

Top 25 and sides 27 and 29 may be constructed in any appropriate fashion, but in this preferred embodiment they are unitarily formed by an appropriate cutting and bending procedure. Top 25 is substantially rectangular, while sides 27 and 29 are generally trapezoidal in shape, with the result that a longitudinal or axial cross section of the mailbox also has a trapezoidal shape. This trapezoidal shape is arranged so that the acute angles 39 and 41 are located at the bottom rear and upper front of the mailbox, respectively. It may be noted that the acute angle 39 is actually defined by a phantom extension of the back edge of sides 27 and 29, since the bottom portion 43 of these edges is made substantially vertical for purposes of mounting bottom 31.

Side 27 may be provided with an appropriate indented portion, such as for the attachment of an identifying name strip. Other identifying indicia, such as a street address could also be located in this space. It should be recognized, of course, that this indentation is not essential to the present invention, but is an aspect of the mailbox incorporating this preferred embodiment.

Figure 3:
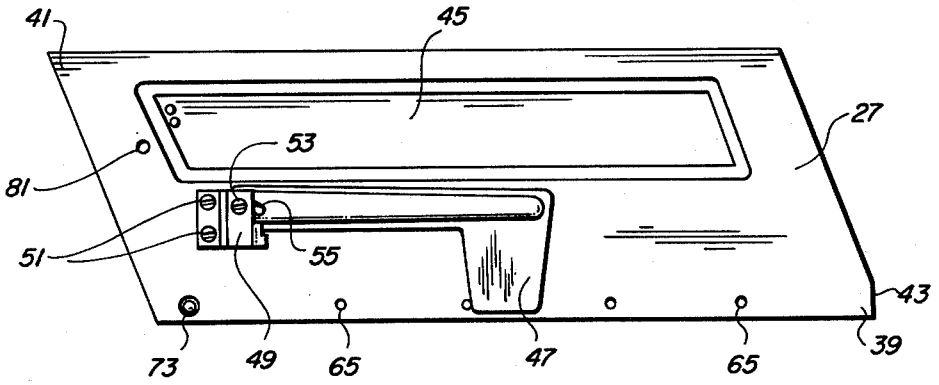
FIG. 3 is a side elevational view of the mailbox of FIG. 1.
Figure 5:
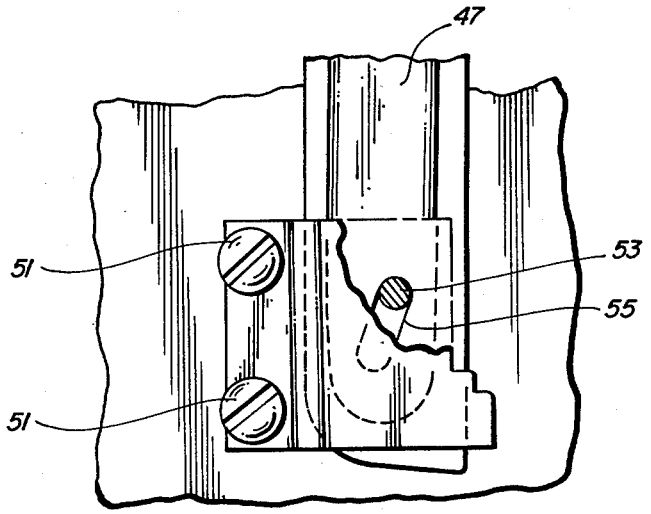
FIG. 5 is an enlarged, partially broken away view of the mounting of the flag on the mailbox of FIG. 1.

An appropriate signaling flag 47 may be mounted on one side of the mailbox. A mounting bracket 49 is affixed to the side of the mailbox by suitable fastening devices, such as the removable screws 51. Another screw 53 is utilized to provide a pivot and mounting post for the flag 47, as illustrated in greater detail in FIG. 5. It may be seen that the post 53 is located in an angled slot 55 formed in the flag 47. When flag 47 is in the down position, as illustrated in FIGS. 1 and 3, the post 53 is in the bottom of the slot 55. However, when the flag is raised to the position in phantom lines in FIG. 1, which corresponds to the position shown in FIG. 5, mounting post 53 is moved to the top of the slot 55. This lowering of the leg of the flag results in securing the flag in this position, until it is manually raised to release it for pivoting to the down position. The mounting screws 51 and 53 may be selectively removed for ganging or combining a number of the mailboxes 21, as described in the co-pending U.S. patent application Ser. No. 812,373.

Figure 4:
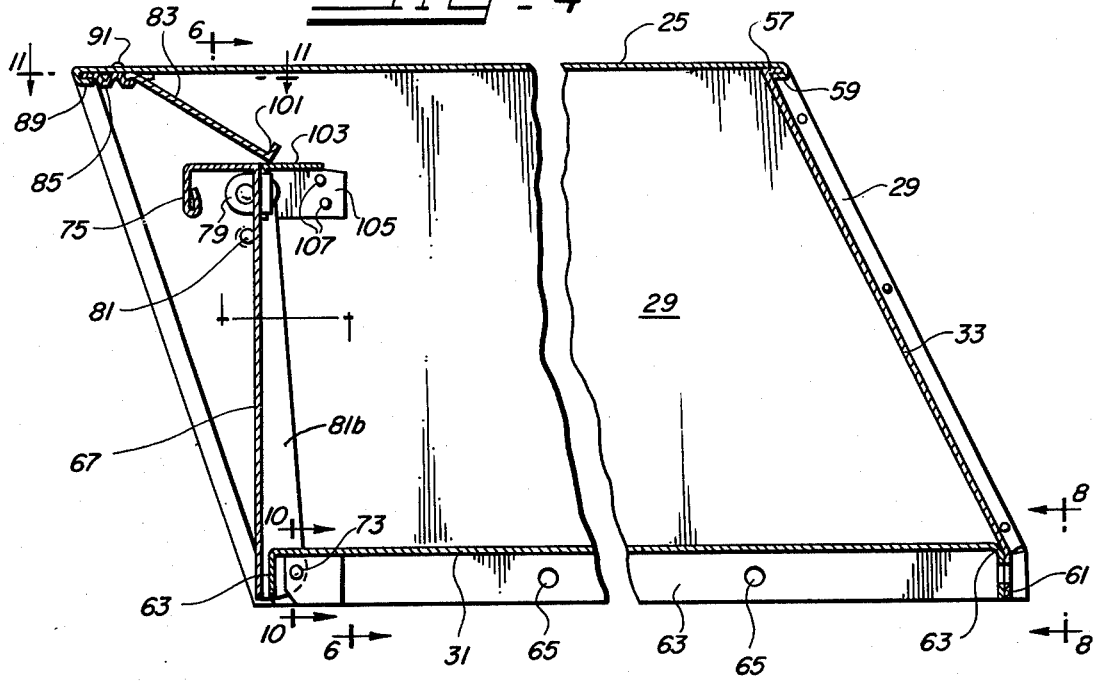
FIG. 4 is an enlarged cross-sectional view taken along line 4—4 in FIG. 2.

With reference specifically to FIG. 4, it may be seen that back 33 of mailbox 21 has a bent end 57, which mates with a corresponding bent end 59 of top 25. The bottom end 61 of back 33 is substantially vertical to conform to the bottom portion 43 of the back edge of the sides 27 and 29. It may be noted that the back 33 is slightly inset from the ends of sides 27 and 29 by an amount corresponding to the length of the in-turned end 59 of top 25.

Figure 6:
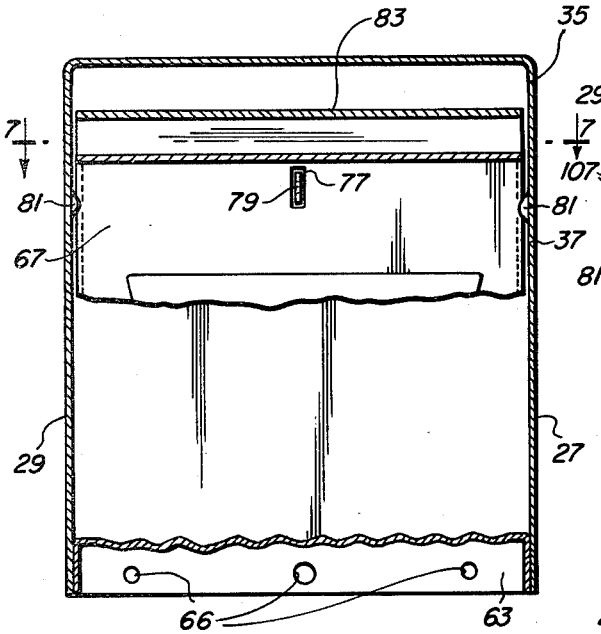
FIG. 6 is a cross-sectional view taken along line 6—6 in FIG. 4.
Figure 8:
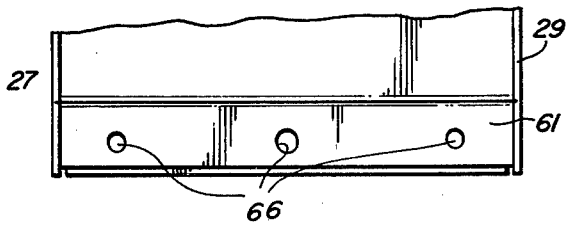
FIG. 8 is a partial elevational view taken along line 8—8 of FIG. 4.

Bottom 31 is also inset from the bottom of sides 27 and 29 by the length of an extending flange 63 located around nearly the entire periphery of the generally rectangular bottom 31. This depending flange 63 is secured to the bottom portions of sides 27 and 29 by appropriate fastening devices, such as rivets 65. In addition, the bottom 61 of back 33 is secured to the flange 63 by appropriate fastening devices, such as the rivets 66 (FIGS. 6 and 8). Thus, the depending flange 63 provides a strengthening member around the sides and back of the mailbox 21.

Figure 10:
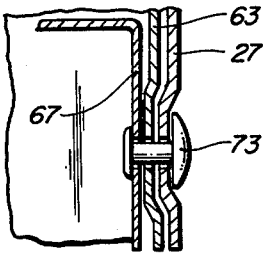
FIG. 10 is a partial cross-sectional view taken along line 10—10 of FIG. 4.

Access opening 37 at the front of mailbox 21 is selectively closed by an appropriate door 67. Door 67 is rectangular in shape and may have appropriate indentations 69 and 71, if so desired. Door 67 is pivotably mounted at the bottom front end of mailbox 21 by any appropriate mounting arrangement, such as rivets 73. As may be better seen in the fragmentary cross-sectional view of FIG. 10, the rivets 73 extend through the walls 27 and 29, the depending strengthening flange 63 of bottom 31 and the door 67. Rivets 73 have sufficient clearance to permit free pivoting of the door 67.

At the top of door 67, a generally L-shaped section is formed to provide a handle 75 for the door 67. A vertical slit 77 (FIG. 6) is formed in door 67 behind handle 75 to permit passage of a suitable lock supporting bight 79.

It will be noted that door 67 fits within sides 27 and 29. While this fit is made relatively close, it does not provide as good a seal as does the overlapping structure of prior art rural mailboxes.

Figure 7:
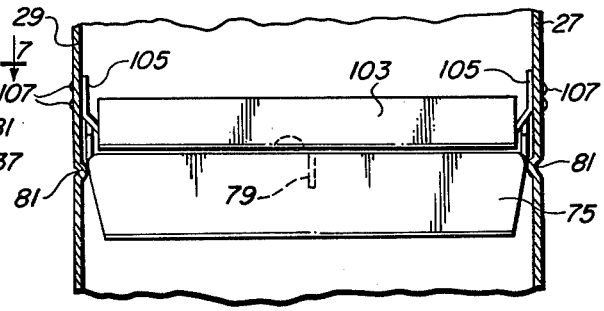
FIG. 7 is a cross-sectional view taken along line 7—7 of FIG. 6.

A latching arrangement for the door 67 is provided by dimples 81 formed in sides 27 and 29 of mailbox 21 and by tabs 81*b* formed on the door 67. These dimples 81 extend into the interior of mailbox 21 by an amount sufficient to form an interference fit with tabs 81*b* on the door 67, when it is closed, to latch it in the closed position, as illustrated in FIGS. 4, 6, and 7. However, the interference fit may be relatively easily overcome by application of a suitable force to the handle 75 of door 67 to provide for manual opening of the door. When door 67 is open, mail reposing in the interior of body 23 of mailbox 21 may be removed.

Figure 11:
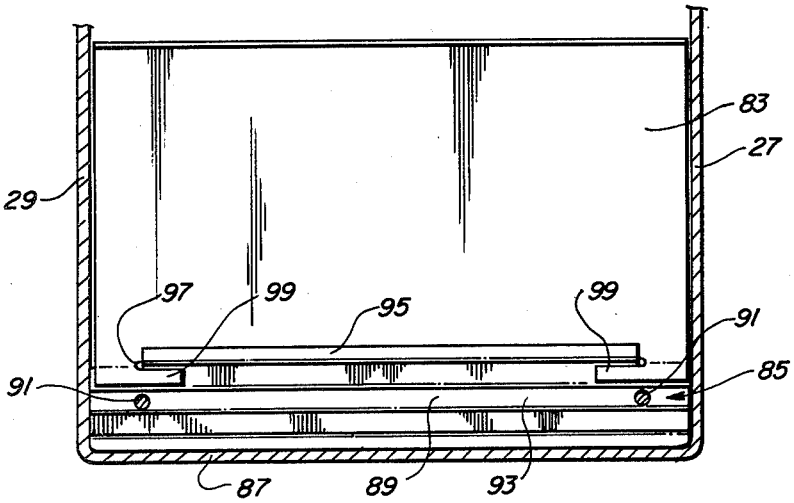
FIG. 11 is an enlargd partial cross-sectional view taken along line 11—11 of FIG. 4.

Mail slot 35 is located above the access opening 37 and has a size sufficient to permit the insertion of mail into the body portion 23 of mailbox 21, but is small enough to prevent access to the interior of the mailbox for removal of mail located therein. Mail slot 35 is provided with a covering flap 83. Flap 83 is pivotably mounted in a pivot mounting support 85 attached to the top 25 of mailbox 21. As may best be seen in FIG. 9, an end portion 87 of pivot mounting support 85 is pinched by an inwardly turned end 89 of top 25. Suitable fastening or securing devices, such as rivets 91 extend through a portion 93 of the pivot mounting support 85 and the top 25 to secure pivot mountings support 85 to the top 25. A portion 95 of pivot mounting support 85 extends through a suitable opening 97 formed in the flap 83. As may be seen in FIG. 11, extending arms 99 are located immediately behind the portion 95 to prevent flap 83 from disengaging from the portion 95.

Figure 9:
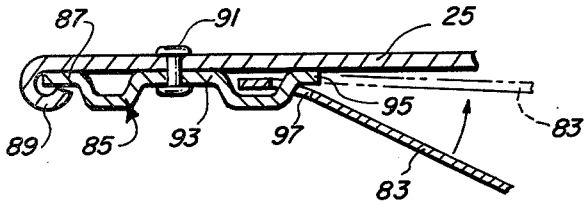
FIG. 9 is an enlarged partial cross-sectional view of the mounting for the flap in FIG. 4.

Normally, flap 83 is pivoted downwardly by the force of gravity to the position shown in FIGS. 4 and 9. When mail is being inserted, flap 83 is pivoted upwardly and inwardly to the position shown in phantom lines in FIG. 9 to permit the insertion of mail into the mailbox 21.

In its downward position, an end 101 of flap 83 rests on a locking bar 103. Locking bar 103 also provides the mounting for lock supporting bight 79. As may be seen in FIGS. 4 and 7, locking bar 103 is provided with mounting brackets 105, which are secured to sides 27 and 29 by suitable fastening means, such as rivets 107. Locking bar 103 serves to define the mail slot 35 and access opening 37, mount the lock supporting bight 79, support flap 83 when mail is not being inserted into mailbox 21, and provide a limiting and positioning stop for door 67 in the closed position.

With this arrangement, the top 25 and sides 27 and 29 of mailbox 21 provide a shielding structure for the mail slot 35 and the door 67 in access opening 37. Therefore, a mailbox has been provided in which the main access door 67 may be locked to prevent unauthorized access by locating a padlock or other suitable locking device in the lock supporting bight 79. At the same time, the mailman may insert mail into mailbox 21 through the mail slot 35, without having to open the door 67 closing the access opening 35. At the same time, the trapezoidal shape of the mailbox provides shielding for the mail slot and access opening to prevent the intrusion of moisture or other foreign matter into the mailbox as a result of adverse weather conditions.

It should be understood that various modifications, changes and variations may be made in the arrangements, operation and details of construction of the elements disclosed herein without departing from the spirit and scope of this invention.

We claim:

1. A theft preventing outdoor mailbox comprising:

a body portion for holding and enclosing mail, said body portion including a top and two sides with the front ends of said sides being inclined so that acute angles are formed between said top and the front ends of said sides;

an access aperture through which mail located in said body portion may be removed formed in the front of said body portion;

a door for selectively closing to prevent, and opening to permit, withdrawal of mail from said body portion through said access aperture, said door pivotably mounted adjacent the bottom of the front ends of said sides and fitting within the inclined front ends of said sides upon being closed;

locking mounting means to provide for the locking of said door to prevent access to the interior of said body portion by unauthorized parties;

a mail slot opening to the interior of said body portion when said door is closed, said mail slot being sufficiently large to permit the insertion of mail into said body portion and small enough to prevent access to the interior of said body portion for the removal of mail therein;

a tab located on each side of said door; and a pair of dimples formed in said sides of said body portion, said tabs engaging said dimples with an interference fit when said door is in the closed position, thereby maintaining said door in its closed position.

2. A theft preventing outdoor mailbox comprising:

an elongated body portion to hold and enclose mail and having a generally trapezoidal cross-section along the longitudinal axis and a generally rectangular cross-section transverse to the longitudinal axis, the acute angles on said trapezoidal cross-section being located at the upper front and lower rear of said body portion;

an access aperture formed in the lower part of the front end of said body portion, said access aperture providing for the removal of mail located in said body portion;

a generally rectangular door pivotably mounted adjacent the lower front on said body portion for rotation about its lower edge, said door selectively closing and opening said access opening;

a locking bar secured to said body portion and extending across said body portion at the top of said access aperture, said door contacting said locking bar in the closed position to orient said door in a substantially vertical plane;

a lock receiving bight mounted on said locking bar and extending toward the front of said body portion, a slit formed in said door to permit the passage of said bight therethrough;

a mail slot formed between said locking bar and the top of said body portion, said mail slot being sufficiently large to permit the insertion of mail into said body portion and small enough to prevent access to the interior of said body portion for the removal of mail therein; and a flap having its top edge pivotably mounted on the top of said body portion at a point spaced toward the front of said body portion from said locking bar, the bottom of said flap extending beyond said locking bar and normally resting thereon under the force of gravity, said flap being pivoted upwardly and inwardly upon the insertion of mail, whereby the mailbox may be locked to prevent unauthorized removal of mail and yet mail may be inserted by the postman through said mail slot, the door, the mail slot and the locking support all being protected from adverse weather conditions by the extending top and sides of said body portion.

3. A mailbox as claimed in claim 2 and further comprising a handle having a generally L-shaped cross-section extending along the top of said door.

4. A mailbox as claimed in claim 2 and further comprising:

tabs located on said door; and dimples formed in the walls of said body portion, said tabs engaging said dimples with an interference fit to provide a latching arrangement for said door.

5. A mailbox as claimed in claim 2 and further comprising a flag removably attached to said body portion.

* * * * *

UNITED STATES PATENT AND TRADEMARK OFFICE

CERTIFICATE OF CORRECTION

PATENT NO. : 4,190,192

DATED : February 26, 1980

INVENTOR(S) : Alexander M. Cornwell, Jr., Joseph N. Miller

It is certified that error appears in the above-identified patent and that said Letters Patent are hereby corrected as shown below:

Column 6, line 38, "on" should read --of--.

Column 6, line 10, "locking mounting" should read --lock mounting--.

Signed and Sealed this

*Twenty-second* Day of *July 1980*

[SEAL]

*Attest:*

SIDNEY A. DIAMOND

*Attesting Officer*

*Commissioner of Patents and Trademarks*